US012264291B2

(12) United States Patent
Shimura et al.

(10) Patent No.: US 12,264,291 B2
(45) Date of Patent: Apr. 1, 2025

(54) LUBRICANT COMPOSITION

(71) Applicant: NOK KLUEBER CO., LTD., Tokyo (JP)

(72) Inventors: Akihiko Shimura, Ibaraki (JP); Toshio Nitta, Ibaraki (JP); Keita Nakashi, Ibaraki (JP)

(73) Assignee: NOK KLUEBER CO., LTD., Tokyo (JP)

( * ) Notice: Subject to any disclaimer, the term of this patent is extended or adjusted under 35 U.S.C. 154(b) by 0 days.

(21) Appl. No.: 18/009,108

(22) PCT Filed: Jun. 3, 2021

(86) PCT No.: PCT/JP2021/021128
§ 371 (c)(1),
(2) Date: Dec. 8, 2022

(87) PCT Pub. No.: WO2021/251250
PCT Pub. Date: Dec. 16, 2021

(65) Prior Publication Data

US 2023/0250355 A1 Aug. 10, 2023

(30) Foreign Application Priority Data

Jun. 9, 2020 (JP) ..... 2020-100512

(51) Int. Cl.
*C10M 135/10* (2006.01)
*C10M 169/04* (2006.01)
*C10N 30/12* (2006.01)

(52) U.S. Cl.
CPC ..... *C10M 135/10* (2013.01); *C10M 169/04* (2013.01); *C10M 2203/003* (2013.01); *C10M 2207/2855* (2013.01); *C10M 2215/1026* (2013.01); *C10M 2219/044* (2013.01); *C10N 2030/12* (2013.01)

(58) Field of Classification Search
CPC ..... C10M 135/10; C10M 169/04; C10M 2203/003; C10M 2207/2855; C10M 2215/1026; C10M 2219/044; C10N 2030/12
See application file for complete search history.

(56) References Cited

U.S. PATENT DOCUMENTS

| | | | | |
|---|---|---|---|---|
| 3,470,097 | A * | 9/1969 | Lavigne et al. | C07C 309/31 508/391 |
| 4,601,840 | A * | 7/1986 | Zehler | C10M 169/04 585/12 |
| 4,895,674 | A | 1/1990 | Gallacher et al. | |
| 5,023,016 | A | 6/1991 | Gallacher et al. | |
| 5,133,900 | A | 7/1992 | Gallacher et al. | |
| 5,169,564 | A | 12/1992 | Gallacher et al. | |
| 5,221,490 | A | 6/1993 | Tajiri et al. | |
| 5,958,850 | A | 9/1999 | Matsuzaki et al. | |
| 6,436,882 | B1 | 8/2002 | Rizvi | |
| 2011/0306529 | A1 * | 12/2011 | Schober | C10M 167/00 508/273 |
| 2012/0142566 | A1 | 6/2012 | Yamamoto | |
| 2018/0087569 | A1 | 3/2018 | Inoue et al. | |
| 2019/0218474 | A1 | 7/2019 | Yoshizaki et al. | |
| 2019/0249103 | A1 * | 8/2019 | Takegami | C10M 169/04 |

FOREIGN PATENT DOCUMENTS

| | | | | |
|---|---|---|---|---|
| CN | 104927973 | A | 9/2015 | |
| CN | 104946352 | A | 9/2015 | |
| CN | 112126494 | A * | 12/2020 | C10M 169/044 |
| GB | 886950 | A | 1/1962 | |
| JP | S63-230795 | | 9/1988 | |
| JP | H04-149297 | A | 5/1992 | |
| JP | H04-314795 | A | 11/1992 | |
| JP | H06-002168 | A | 1/1994 | |
| JP | H10-280176 | | 10/1998 | |
| JP | H10-317176 | | 12/1998 | |
| JP | 2003-082378 | | 3/2003 | |
| JP | 2004-091764 | | 3/2004 | |
| JP | 4351945 | | 10/2009 | |
| JP | 2011-042747 | | 3/2011 | |
| JP | 5672631 | | 2/2015 | |
| JP | 2015-086428 | | 5/2015 | |
| JP | 2018-059618 | | 4/2018 | |
| JP | 2020-132644 | | 8/2020 | |
| WO | WO-9635765 | A1 * | 11/1996 | C10M 141/08 |
| WO | 2010/013708 | | 2/2010 | |
| WO | 2011/019028 | | 2/2011 | |

(Continued)

OTHER PUBLICATIONS

English-language machine translation of CN112126494A (Year: 2020).*
ISR/WO issued in WIPO Patent Application No. PCT/JP2021/021128, Aug. 10, 2021, translation of ISR.
IPRP/translation of WO issued in WIPO Patent Application No. PCT/JP2021/021128, Dec. 13, 2022, translation.
Office Action issued in JP Patent Application No. 2022-530511, Oct. 3, 2023, translation.
Office Action issued in CN Patent Application No. 202180040919.1, Jun. 7, 2023, translation.

(Continued)

*Primary Examiner* — James C Goloboy
(74) *Attorney, Agent, or Firm* — GREENBLUM & BERNSTEIN, P.L.C.

(57) ABSTRACT

A lubricant composition containing a base oil, an alkyl benzene sulfonate metal salt, and an alkyl naphthalene sulfonate metal salt, wherein a total content of the alkyl benzene sulfonate metal salt and the alkyl naphthalene sulfonate metal salt is 1 to 2.2% by mass, and a mass fraction of the alkyl benzene sulfonate metal salt to a total mass of the alkyl benzene sulfonate metal salt and the alkyl naphthalene sulfonate metal salt is 0.3 or more.

4 Claims, No Drawings

(56) References Cited

FOREIGN PATENT DOCUMENTS

| | | |
|---|---|---|
| WO | 2018/061134 | 4/2018 |
| WO | 2018/088013 A1 | 5/2018 |

OTHER PUBLICATIONS

Office Action issued in CN Patent Application No. 202180040919.1, Nov. 17, 2023, translation.
Extended European Search Report issued in EP Patent Application No. 21821859.2, issued Apr. 25, 2024.

* cited by examiner

LUBRICANT COMPOSITION

CROSS REFERENCE TO RELATED APPLICATIONS

This is the National Stage of International Application No. PCT/JP2021/021128 filed on Jun. 3, 2021, which claims the benefit of Japanese Patent Application No. 2020-100512, filed on Jun. 9, 2020, the disclosures of which are hereby incorporated by reference in their entirety.

TECHNICAL FIELD

The present disclosure relates to a lubricant composition.

BACKGROUND ART

Development of lubricant compositions to improve rust-prevention of metals has been advancing for a long time. Japanese Patent No. 4351945 discloses a rust-preventive agent composition containing wax and at least one selected from a sulfonic acid salt, a carboxylic acid, an ester, a sarcosine, an amine, and a boron compound. Japanese Patent No. 5672631 discloses a lubricant composition that contains a base oil, and as additives a neutral metal sulfonate, an over-base metal sulfonate, an asparagine acid derivative, and a phosphoric ester and that has friction characteristics, wear resistance, and rust-prevention. International Publication No. WO 2011/019028 discloses a grease composition that contains an alicyclic urea grease and at least one selected from a naphthenic acid metal salt, an aliphatic amine salt, and an organic sulfonic acid metal salt and that is excellent in fretting resistance.

SUMMARY OF DISCLOSURE

Technical Problem

Development of a lubricant composition superior in rust-prevention to a conventional lubricant composition has been desired. Therefore, the present inventors have found that superior rust-prevention can be imparted to metals and alloys by containing 2 types of specific metal salts with a specific weight ratio, and arrived at completion of the present disclosure. That is, the present disclosure provides a lubricant composition excellent in rust-prevention.

Solution to Problem

Each embodiment of the present disclosure is as follows.

[1] A lubricant composition containing:

a base oil;

an alkyl benzene sulfonate metal salt; and an alkyl naphthalene sulfonate metal salt, wherein a total content of the alkyl benzene sulfonate metal salt and the alkyl naphthalene sulfonate metal salt is 1 to 2.2% by mass, and a mass fraction of the alkyl benzene sulfonate metal salt to a total mass of the alkyl benzene sulfonate metal salt and the alkyl naphthalene sulfonate metal salt is 0.3 or more.

[2] The lubricant composition according to [1], wherein the alkyl benzene sulfonate metal salt is an alkyl benzene sulfonate calcium salt, and the alkyl naphthalene sulfonate metal salt is an alkyl naphthalene sulfonate barium salt.

[3] The lubricant composition according to [1] or [2], wherein the alkyl benzene sulfonate metal salt has 2 alkyl groups.

[4] The lubricant composition according to any one of [1] to [3], which is an aluminum rust-preventive agent.

Effects of Disclosure

A lubricant composition having excellent rust-prevention can be provided.

DESCRIPTION OF EMBODIMENTS

A lubricant composition of the present-invention disclosure contains a base oil, an alkyl benzene sulfonate metal salt, and an alkyl naphthalene sulfonate metal salt. A total content of the alkyl benzene sulfonate metal salt and the alkyl naphthalene sulfonate metal salt in the lubricant composition is 1 to 2.2% by mass. Due to the total content of 1% by mass or more and 2.2% by mass or less, a sufficient protective film can be formed on a metal surface. Further, a mass fraction (mass ratio) of the alkyl benzene sulfonate metal salt to a total mass of the alkyl benzene sulfonate metal salt and the alkyl naphthalene sulfonate metal salt, that is (the mass of the alkyl benzene sulfonate metal salt)/(the total mass of the alkyl benzene sulfonate metal salt and the alkyl naphthalene sulfonate metal salt), is 0.3 or more. Due to the mass fraction of 0.3 or more of the alkyl benzene sulfonate metal salt, a more stable protective film of additives (the alkyl benzene sulfonate metal salt and the alkyl naphthalene sulfonate metal salt) can be formed. In the lubricant composition of the present disclosure, by containing the alkyl benzene sulfonate metal salt and the alkyl naphthalene sulfonate metal salt with a specific content and a content ratio, these metal salts synergistically act to form the protective film of the additives (the alkyl benzene sulfonate metal salt and the alkyl naphthalene sulfonate metal salt) which is more stable and robust, thereby being able to effectively prevent elution of metals and alloys onto which the lubricant composition is applied and generation of chloride and a hydroxide. As a result, corrosion progress of the metal and the alloy can be effectively suppressed Hereinafter, each component forming the lubricant composition of the present disclosure will be described in detail.

(Base Oil)

The type of the base oil is not particularly limited, and includes, for example, a synthetic oil, a mineral oil, etc. The synthetic oil and the mineral oil may be used singly or in a mixture thereof. The synthetic oil includes, for example, a hydrocarbon oil such as a poly α-olefin, an ethylene-α-olefin copolymer, a polybutene (a polyisobutylene), an alkyl benzene, and an alkyl naphthalene; an ester oil such as a diester (an ester of a dicarboxylic acid and a mono-alcohol), a polyol ester, and an aromatic ester; and an ether oil such as an alkyl diphenyl ether. These synthetic oils may be used singly or in a mixture of two or more thereof. The aromatic ester includes, for example, a phthalic acid ester, an isophthalic acid ester, a trimellitic acid ester, a pyromellitic acid ester, and the like. The polyol ester includes, for example, an ester of a polyhydric alcohol and a monocarboxylic acid. The polyhydric alcohol is preferably the polyhydric alcohol having no β hydrogen. Such a polyhydric alcohol includes, for example, trimethylolpropane, ditrimethylolpropane, trimethylolethane, ditrimethylolethane, pentaerythritol, dipentaerythritol, tripentaerythritol, neopentyl glycol, and the like. Further, the monocarboxylic acid includes a monovalent fatty acid having 4 to 16 carbon atoms and the like such as butyric acid, valeric acid, caproic acid, enanthic acid, caprylic acid, pelargonic acid, capric acid, undecanoic acid, lauric acid, tridecylic acid, myristic acid, pentadecylic acid, and palmitic acid. More specifically, the base oil includes tri (n-$C_8$-$C_{10}$ alkyl) trimellitate.

(Alkyl Benzene Sulfonate Metal Salt)

The alkyl benzene sulfonate metal salt is not particularly limited as long as it does not impair the effects of the present disclosure. The alkyl benzene sulfonate metal salt is a metal salt of an alkyl benzene sulfonic acid, in which an alkyl group is bonded to at least one carbon atom forming a benzene ring. The number of the alkyl groups is not particularly limited, and the alkyl benzene sulfonate metal salt can have 1 to 5 alkyl groups, and it is preferable that it has 2 alkyl groups. It is preferable that the alkyl group has a long chain to the extent that it exhibits lipophilicity. More specifically, the alkyl group preferably has 9 to 40 carbon atoms, more preferably 9 to 36 carbon atoms. The alkyl group includes, for example, a C10-C18 alkyl group, a C15-C36 branched group, and the like. The alkyl benzene sulfonate metal salt includes, for example, the alkyl benzene sulfonate metal salt having the following structures of general formulae (1) and (2):

[Formula 1]

(1)

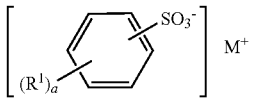

(2)

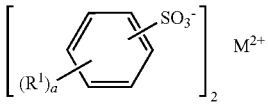

In the above general formulae (1) and (2), a is an integer of 1 to 5, and when a=1, $R^1$ is an alkyl group, and when a=2 to 5, each $R^1$ independently represents an alkyl group or an organic group, provided that at least one $R^1$ is an alkyl group. $M^{2+}$ of the above general formula (1) represents a monovalent metal cation; and $M^{2+}$ of the above general formula (2) represents a divalent metal cation. The content of the alkyl benzene sulfonate metal salt in the lubricant composition is preferably 0.3 to 2.1% by mass, more preferably 0.5 to 2.1% by mass, even more preferably 1 to 2.1% by mass. By setting the content of the alkyl benzene sulfonate metal salt in the lubricant composition in a range described above, a surface of the metal and the alloy can be effectively protected. A metal forming the alkyl benzene sulfonate metal salt is not particularly limited, and includes, for example, an alkali metal (Li, Na, K), an alkaline earth metal (Ca, Sr, Ba), and the like. Preferably, the alkyl benzene sulfonate metal salt is an alkyl benzene sulfonate calcium salt. Further, it is preferable that the alkyl benzene sulfonate calcium salt has 2 alkyl groups.

(Alkyl Naphthalene Sulfonate Metal Salt)

The alkyl naphthalene sulfonate metal salt is not particularly limited as long as it does not impair the effects of the present disclosure. The alkyl naphthalene sulfonate metal salt is the metal salt of the alkyl naphthalene sulfonic acid, in which the alkyl group is bonded to at least one carbon atom forming a naphthalene ring. The number of alkyl groups is not particularly limited, and the alkyl naphthalene sulfonate metal salt can have 1 to 7 alkyl groups. It is preferable that the alkyl group has the long chain to the extent that it exhibits the lipophilicity. More specifically, the alkyl group preferably has 9 to 40 carbon atoms, more preferably 9 to 36 carbon atoms. The alkyl group includes, for example, a nonyl group, and the like. The alkyl naphthalene sulfonate metal salt includes, for example, alkyl naphthalene sulfonate metal salt having the following structures of general formulae (3) and (4):

[Formula 2]

(3)

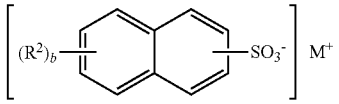

(4)

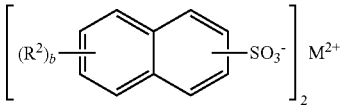

In the above general formulae (3) and (4), b is an integer of 1 to 7, and when b=1, $R^2$ is an alkyl group, and when b=2 to 7, each $R^2$ independently represents an alkyl group or an organic group, provided that at least one $R^2$ is an alkyl group. $M^{2+}$ of the above general formula (3) represents a monovalent metal cation and $M^{2+}$ of the above general formula (4) represents a divalent metal cation. The content of the alkyl naphthalene sulfonate metal salt in the lubricant composition is preferably 0.1 to 1.54% by mass, more preferably 0.1 to 1.5% by mass, even more preferably 0.2 to 1.3% by mass. By setting the content of the alkyl naphthalene sulfonate metal salt in the lubricant composition in the range described above, the surface of the metal and the alloy can be effectively protected. The metal forming the alkyl naphthalene sulfonate metal salt is not particularly limited, and includes, for example, the alkali metal (Li, Na, K), the alkaline earth metal (Ca, Sr, Ba), and the like. Preferably, the alkyl naphthalene sulfonate metal salt is an alkyl naphthalene sulfonate barium salt.

Each of the alkyl benzene sulfonate metal salt and the alkyl naphthalene sulfonate metal salt has a rust-prevention action, and the lubricant composition can form a protective film of the additives (the alkyl benzene sulfonate metal salt and the alkyl naphthalene sulfonate metal salt) which is more stable and robust, by containing these 2 types of metal salts. The total content of the alkyl benzene sulfonate metal salt and the alkyl naphthalene sulfonate metal salt in the lubricant composition is 1 to 2.2% by mass. The total content of the alkyl benzene sulfonate metal salt and the alkyl naphthalene sulfonate metal salt is preferably 1.2 to 2.2% by mass, more preferably 1.8 to 2.2% by mass. The mass fraction (mass ratio) of the alkyl benzene sulfonate metal salt to the total mass of the alkyl benzene sulfonate metal salt and the alkyl naphthalene sulfonate metal salt, that is (the mass of the alkyl benzene sulfonate metal salt)/(the total mass of the alkyl benzene sulfonate metal salt and the alkyl naphthalene sulfonate metal salt), is 0.3 or more. (The mass of the alkyl benzene sulfonate metal salt)/(the total mass of the alkyl benzene sulfonate metal salt and the alkyl naphthalene sulfonate metal salt) is preferably 0.3 to 0.98, more preferably 0.3 to 0.95, even more preferably 0.5 to 0.9.

(Other Additives)

The lubricant composition of one embodiment can contain a thickener, an antioxidant, an extreme-pressure additive, a viscosity index improver, and the like appropriately selected, within the extent that the object of the present disclosure is not impaired; however, it is desired that a metallic soap-based thickener having high affinity with water is not used because it elutes in water or reacts with water to cause hydrolysis. The thickener includes, for example, carbon black, AEROSIL, BENTONE, terephthalamate, urea, phthalocyanine, polytetrafluoroethylene, melamine cyanurate, and the like. The urea of the thickener includes a reactant of 4,4'-diphenylmethane diisocyanate and n-octylamine. The antioxidant includes a phenol-based antioxidant, an amine-based antioxidant, a phosphorous-based antioxidant, a sulfur-based antioxidant, and the like. The extreme-pressure additive includes, for example, a phosphorus-based compound such as a phosphoric ester, a phosphite ester, and a phosphoric ester amine salt; a sulfur compound such as sulfides and disulfides; a sulfur-based metal salt such as a dialkyldithiophosphoric acid metal salt, and dialkyldithiocarbamic acid metal salt; and a chlorine compound such as a chlorinated paraffin, and a chlorinated diphenyl. More specifically, the extreme-pressure additive includes ZnDTP (zinc dialkyldithiophosphate). The viscosity index improver includes a polymethacrylate, an ethylene-propylene copolymer, a polyisobutylene, a polyalkylstyrene, a styrene-isoprene copolymer hydride, and the like.

The lubricant composition of one embodiment can be suitably used as a rust-preventive agent of for metal and the alloy material by being applied onto the surface of the metal and the alloy material. The type of the metal and the alloy onto which the lubricant composition is applied is not particularly limited, and it is preferable that the lubricant composition is an aluminum rust-preventive agent. On this occasion, the aluminum alloy onto which the lubricant composition is applied includes a variety of the following alloys specified in ISO/FDIS 3522.

ADC1 (1.0% by mass or less of Cu, 11.0 to 13.0% by mass of Si, 0.3% by mass or less of Mg, 0.5% by mass or less of Zn, 1.3% by mass or less of Fe, 0.3% by mass or less of Mn, 0.5% by mass or less of Ni, 0.1% by mass or less of Sn, 0.20% by mass or less of Pb, 0.30% by mass or less of Ti, and the balance of Al);

ADC3 (0.6% by mass or less of Cu, 9.0 to 11.0% by mass of Si, 0.4 to 0.6% by mass of Mg, 0.5% by mass or less of Zn, 1.3% by mass or less of Fe, 0.3% by mass or less of Mn, 0.5% by mass or less of Ni, 0.1% by mass or less of Sn, 0.15% by mass or less of Pb, 0.30% by mass or less of Ti, and the balance of Al);

ADC5 (0.2% by mass or less of Cu, 0.3% by mass or less of Si, 4.0 to 8.5% by mass of Mg, 0.1% by mass or less of Zn, 1.8% by mass or less of Fe, 0.3% by mass or less of Mn, 0.1% by mass or less of Ni, 0.1% by mass or less of Sn, 0.10% by mass or less of Pb, 0.20% by mass or less of Ti, and the balance of Al);

ADC6 (0.1% by mass or less of Cu, 1.0% by mass or less of Si, 2.5 to 4.0% by mass of Mg, 0.4% by mass or less of Zn, 0.8% by mass or less of Fe, 0.4 to 0.6% by mass of Mn, 0.1% by mass or less of Ni, 0.1% by mass or less of Sn, 0.10% by mass or less of Pb, 0.20% by mass or less of Ti, and the balance of Al);

ADC10 (2.0 to 4.0% by mass of Cu, 7.5 to 9.5% by mass of Si, 0.3% by mass or less of Mg, 1.0% by mass or less of Zn, 1.3% by mass or less of Fe, 0.5% by mass or less of Mn, 0.5% by mass or less of Ni, 0.2% by mass or less of Sn, 0.20% by mass or less of Pb, 0.30% by mass or less of Ti, and the balance of Al);

ADC10Z (2.0 to 4.0% by mass of Cu, 7.5 to 9.5% by mass of Si, 0.3% by mass or less of Mg, 3.0% by mass or less of Zn, 1.3% by mass or less of Fe, 0.5% by mass or less of Mn, 0.5% by mass or less of Ni, 0.2% by mass or less of Sn, 0.20% by mass or less of Pb, 0.30% by mass or less of Ti, and the balance of Al);

ADC12 (1.5 to 3.5% by mass of Cu, 9.6 to 12.0% by mass of Si, 0.3% by mass or less of Mg, 1.0% by mass or less of Zn, 1.3% by mass or less of Fe, 0.5% by mass or less of Mn, 0.5% by mass or less of Ni, 0.2% by mass or less of Sn, 0.20% by mass or less of Pb, 0.30% by mass or less of Ti, and the balance of Al);

ADC12Z (1.5 to 3.5% by mass of Cu, 9.6 to 12.0% by mass of Si, 0.3% by mass or less of Mg, 3.0% by mass or less of Zn, 1.3% by mass or less of Fe, 0.5% by mass or less of Mn, 0.5% by mass or less of Ni, 0.2% by mass or less of Sn, 0.20% by mass or less of Pb, 0.30% by mass or less of Ti, and the balance of Al);

ADC14 (4.0 to 5.0% by mass of Cu, 16.0 to 18.0% by mass of Si, 0.45 to 0.65% by mass of Mg, 1.5% by mass or less of Zn, 1.3% by mass or less of Fe, 0.5% by mass or less of Mn, 0.3% by mass or less of Ni, 0.3% by mass or less of Sn, 0.20% by mass or less of Pb, 0.30% by mass or less of Ti, and the balance of Al).

In the case of using the lubricant composition of one embodiment as the aluminum rust-preventive agent, it can be used for aluminum members such as body panels and chassis parts of vehicles and railway trains; a radiator, a transmission housing, an EPS (Electric Power Steering), an ECU (Electronic Control Unit), a roof carrier, a center pillar, a tank cover, a frame rail, a converter, a motor, a shock tower, a cross member, an oil pump, a water pump, an engine block; and aluminum building materials of building members. More specifically, the lubricant composition of one embodiment can be used as the rust-preventive agent for corrosion protection of the aluminum members, which are used for invertors of the vehicle and industrial machinery, an engaging part of an EPS motor case, a connector, an engaging part of a case, and the like.

EXAMPLES

Hereinafter, preferable embodiments of the present disclosure will be specifically described with reference to Examples and Comparative Examples; however, the present disclosure is not limited to these Examples.

Examples 1 to 7 and Comparative Examples 1 to 13

The lubricant compositions were prepared by blending each material with a compounding ratio shown in the following Tables 1 and 2. Next, 2 aluminum alloy plates were prepared. The aluminum alloy plates used had the following material and dimensions.

Material: ADC12, 2.37% by mass of Cu, 10.55% by mass of Si, 0.01% by mass of Zn, 0.12% by mass of Fe, 0.01% by mass of Ni, and 86.94% by mass of Al.

Dimensions: 20 mm×20 mm in length and 5 mm in thickness.

Surface Roughness Ra: 0.5 μm.

Between the 2 plates of the above aluminum alloy plates, 0.5 ml of the lubricant composition prepared in each example was applied to make a test piece, and the test piece was fixed by test piece jigs. The test piece jigs were arranged to catch the test piece between a pair of the jigs opposed each other, and fixed by tightening screws at four corners of the pair of the jigs at 2 Nm of tightening torque. After this, the test piece was subjected to a salt water immersion test.

Specifically, in the salt water immersion test, the test jigs to which the test piece was fixed was immersed in the salt water having a concentration of 3% by mass at 80° C. filled in an isothermal tank, to leave to stand for 100 hours. Next, the test piece was taken out of the salt water, to be dried under room temperature for 24 hours. With respect to the aluminum alloy plates after drying, a growth distance of rust from an end face was visually observed. Then, it was evaluated as follows: one in which the rust was not observed on surfaces of the aluminum alloy plates and the growth distance of the rust was 0 mm was "Good" as excellent in rust-prevention; one in which the growth distances of the rust from the end faces of surfaces of the aluminum alloy plates was more than 0 mm and less than 1 mm was "Fair" as within acceptable in rust-prevention; and one in which the growth distances of the rust from the end faces of surfaces of the aluminum alloy plates was 1 mm or more was "Poor" as inferior in rust-prevention. The evaluation results are shown in Tables 1 and 2.

TABLE 1

| | Example 1 | Example 2 | Example 3 | Example 4 | Example 5 | Example 6 | Example 7 |
|---|---|---|---|---|---|---|---|
| Base Oil (parts by mass) | 90.4 | 90.4 | 90.4 | 90.4 | 90.4 | 90.4 | 90.4 |
| Thickener (parts by mass) | 9.6 | 9.6 | 9.6 | 9.6 | 9.6 | 9.6 | 9.6 |
| Alkyl naphthalene sulfonate metal salt 1 (parts by mass) | 0.3 | | 1.0 | 0.3 | 0.3 | 1.2 | 0.1 |
| Alkyl naphthalene sulfonate metal salt 2 (parts by mass) | | 0.3 | | | | | |
| Alkyl benzene sulfonate metal salt 1 (parts by mass) | | | | 1.1 | 1.7 | | |
| Alkyl benzene sulfonate metal salt 2 (parts by mass) | 1.7 | 1.7 | 1.0 | | | 0.8 | 1.1 |
| Total content (% by mass) | 2.0 | 2.0 | 2.0 | 1.4 | 2.0 | 2.0 | 1.2 |
| Content Ratio (—) | 0.85 | 0.85 | 0.50 | 0.79 | 0.85 | 0.40 | 0.92 |
| Growth Distance of Rust (mm) | 0 | 0 | 0 | 0.68 | 0.81 | 0.58 | 0.35 |
| Evaluation | Good | Good | Good | Fair | Fair | Fair | Fair |

TABLE 2

| | Comparative Example 1 | Comparative Example 2 | Comparative Example 3 | Comparative Example 4 | Comparative Example 5 | Comparative Example 6 | Comparative Example 7 |
|---|---|---|---|---|---|---|---|
| Base Oil (parts by mass) | 90.4 | 90.4 | 90.4 | 90.4 | 90.4 | 90.4 | 90.4 |
| Thickener (parts by mass) | 9.6 | 9.6 | 9.6 | 9.6 | 9.6 | 9.6 | 9.6 |
| Alkyl naphthalene sulfonate metal salt 1 (parts by mass) | 0.3 | 0.1 | 1.7 | | | | 1.9 |
| Alkyl naphthalene sulfonate metal salt 2 (parts by mass) | | | | | | | |
| Alkyl benzene sulfonate metal salt 1 (parts by mass) | | | | | | 0.2 | |
| Alkyl benzene sulfonate metal salt 2 (parts by mass) | 2.1 | 0.7 | 0.3 | | 1.7 | 1.7 | |
| Extreme-Pressure Agent (parts by mass) | | | | | | | |
| Total content (% by mass) | 2.4 | 0.8 | 2.0 | 0.0 | 1.7 | 1.9 | 1.9 |
| Content Ratio (—) | 0.88 | 0.88 | 0.15 | 0.00 | 1.00 | 1.00 | 0.00 |

TABLE 2-continued

| | | | | | | | |
|---|---|---|---|---|---|---|---|
| Growth Distance of Rust (mm) | 4.76 | 2.31 | 4.08 | 3.27 | 12.11 | 8.71 | 1.9 |
| Evaluation | Poor | Poor | Poor | Poor | Poor | Poor | Poor |

| | Comparative Example 8 | Comparative Example 9 | Comparative Example 10 | Comparative Example 11 | Comparative Example 12 | Comparative Example 13 |
|---|---|---|---|---|---|---|
| Base Oil (parts by mass) | 90.4 | 90.4 | 90.4 | 90.4 | 90.4 | 90.4 |
| Thickener (parts by mass) | 9.6 | 9.6 | 9.6 | 9.6 | 9.6 | 9.6 |
| Alkyl naphthalene sulfonate metal salt 1 (parts by mass) | 0.3 | | | | | 1.6 |
| Alkyl naphthalene sulfonate metal salt 2 (parts by mass) | 1.5 | | 1.5 | | | |
| Alkyl benzene sulfonate metal salt 1 (parts by mass) | | | | | | |
| Alkyl benzene sulfonate metal salt 2 (parts by mass) | | | | 0.3 | 2 | 0.4 |
| Extreme-Pressure Agent (parts by mass) | | 3.0 | | | | |
| Total content (% by mass) | 1.8 | 0.0 | 1.5 | 0.3 | 2.0 | 2.0 |
| Content Ratio (—) | 0.00 | 0.00 | 0.00 | 1.00 | 1.00 | 0.20 |
| Growth Distance of Rust (mm) | 3.54 | 4.08 | 1.36 | 4.76 | 1.09 | 4.13 |
| Evaluation | Poor | Poor | Poor | Poor | Poor | Poor |

A numerical value of each material forming the lubricant compositions in Tables 1 and 2 represents parts by mass. Further, in Tables 1 and 2, "Total Content" represents the total content (% by mass) of the alkyl benzene sulfonate metal salt and the alkyl naphthalene sulfonate metal salt in the lubricant compositions; and "Content Ratio" represents the mass fraction (—) of the alkyl benzene sulfonate metal salt to the total mass of the alkyl benzene sulfonate metal salt and the alkyl naphthalene sulfonate metal salt.

Further, the name of each material in Tables 1 and 2 is as follows.

Base oil: Trimex N-08 (product name), produced by Kao Corporation, tri(normal $C_8$-$C_{10}$ alkyl) trimellitate;

Thickener: A diurea compound (a reactant of 4,4'-diphenylmethane diisocyanate and n-octylamine);

Alkyl naphthalene sulfonate metal salt 1: NA-SUL BSN (product name), produced by Kusumoto Chemicals, Ltd., a dinonylnaphthalene sulfonate barium salt;

Alkyl naphthalene sulfonate metal salt 2: NA-SUL Ca-1089 (product name), produced by Kusumoto Chemicals, Ltd., a dinonylnaphthalene sulfonate calcium salt;

Alkyl benzene sulfonate metal salt 1: ADDITIN RC 4103 (product name), produced by Rhein Chemie Rheinau GmbH, a mono $C_{15}$-$C_{36}$ branched alkyl benzene sulfonate barium salt;

Alkyl benzene sulfonate metal salt 2: ADDITIN RC 4220 (product name), produced by Rhein Chemie Rheinau GmbH, a di $C_{10}$-$C_{18}$ alkyl benzene sulfonate calcium salt; and Extreme-pressure additive: ADEKA-KIKU LUBE Z112, produced by ADEKA Corporation, ZnDTP (zinc dithiophosphate).

From the results of Table 1, the evaluation results of the salt water immersion tests using the lubricant compositions of the present disclosure were "Good" or "Fair", showing excellent rust-prevention in the case of application onto the aluminum alloy plate. In contrast, from the results of Table 2, the evaluation results of the salt water immersion tests not using the lubricant composition of the present disclosure were "Poor", proving to be inferior in rust-prevention in the case of application onto the aluminum alloy plate.

The invention claimed is:

1. A lubricant composition comprising:

a base oil;

a thickener;

a neutral $C_9$-$C_{36}$ alkyl benzene sulfonate metal salt which has 1 or 2 alkyl groups; and a neutral $C_9$ alkyl naphthalene sulfonate metal salt which has 2 alkyl groups, wherein a content of the alkyl benzene sulfonate metal salt in the lubricant composition is 0.8 to 1.7% by mass, a content of the alkyl naphthalene sulfonate metal salt in the lubricant composition is 0.1 to 1.2% by mass, a total content of the alkyl benzene sulfonate metal salt and the alkyl naphthalene sulfonate metal salt in the lubricant composition is 1 to 2.2% by mass, and a mass fraction of the alkyl benzene sulfonate metal salt to a total mass of the alkyl benzene sulfonate metal salt and the alkyl naphthalene sulfonate metal salt is 0.4 to 0.92.

2. The lubricant composition according to claim 1, wherein the alkyl benzene sulfonate metal salt is an alkyl benzene sulfonate calcium salt, and the alkyl naphthalene sulfonate metal salt is an alkyl naphthalene sulfonate barium salt.

3. The lubricant composition according to claim 1, wherein the alkyl benzene sulfonate metal salt has 2 alkyl groups.

4. The lubricant composition according to claim 1, which is an aluminum rust-preventive agent.

* * * * *